US005592779A

United States Patent [19]

Conway

[11] Patent Number: 5,592,779

[45] Date of Patent: Jan. 14, 1997

[54] EXPANDED AREA SAFETY GATE

[76] Inventor: James M. Conway, 9 Woodcrest Rd., Manchester, Mass. 01944

[21] Appl. No.: 509,346

[22] Filed: Jul. 31, 1995

Related U.S. Application Data

[63] Continuation-in-part of Ser. No. 342,590, Nov. 21, 1994.

[51] Int. Cl.[6] ..... E06B 3/32

[52] U.S. Cl. ..... 49/73.1; 49/506; 52/64

[58] Field of Search ..... 49/63, 65, 73.1, 49/506; 52/64, 174

[56] References Cited

U.S. PATENT DOCUMENTS 2,874,819 2/1959 Nutter ..... 49/68 X 4,150,510 4/1979 Harrison et al. ..... 52/64 X

*Primary Examiner*—Philip C. Kannan

*Attorney, Agent, or Firm*—Don Halgren

[57] ABSTRACT

The present invention comprises a frame assembly which may be readily set up at the edge of a mezzanine floor to provide a safety gate thereat. The assembly has a pair of side walls connected by a horizontally disposed overhead support. A front gate and a rear gate assembly are upwardly and downwardly movable, opposed to one anothers motion, so as to provide a blocking of the edge of the mezzanine floor, and to also define an enlarged work area for fork lift trucks or shipping machinery within that area while keeping it safe from accidents.

11 Claims, 3 Drawing Sheets

EXPANDED AREA SAFETY GATE

BACKGROUND OF THE INVENTION

1. Field of the Invention

This invention relates to safety gates, and more particularly to mezzanine-type gates at guard rails, which comprises a continuation-in-part application of my copending earlier filed U.S. application Ser. No. 08/342,590 filed Nov. 21, 1994 which is incorporated herein by reference, in its entirety.

2. Prior Art

Manufacturing facilities must by their nature have an arrangement from which to ship their products. Shipping/receiving/storage and order pick-up departments have their floors at a level which is raised above the ground level, so as to facilitate shipment of those products smoothly into trucks or rail cars. Such a raised floor also of necessity, requires a protective safety rail along its periphery. Those safety rails need to be attachable so as to permit products to be shipped therethrough. Passable type rails are gates. One early gate shown in the prior art, is represented in U.S. Pat. No. 4,041,646 to Mittag. In this arrangement, one or two gates are pivoted about a pair of lower pivot points, to provide an opening, or to deny access to any entry way. Another gate, for such raised floor for mezzanine structures, is shown in U.S. Pat. No. 4,538,379 to Vargo. The gate in this patent has a pair of parallel rails which are pivoted about a pair of exposed axes which has a gate at one end thereof. The rails and the gate define a generally rectangular area. When the gate is closed the gate portion is at one side of the frame assembly. When it is desired to provide access to that gate area, the entire gate assembly is pivoted about those axes so that one gate is now pivoted to the opposite side 180 degrees from its original position. When this particular side frame assembly is in the vertical orientation, there is in fact no gate or barrier to prevent access through or over the mezzanine floor.

A further safety gate arrangement is shown is U.S. Pat. No. 5,241,789 to Vacelet, which shows an apparatus for protecting an elevator shaft opening. The opening at the shaft door comprises a railing which is secured to the door by two hinged parallelogram linkages. The protective railing is moveable between two horizontally spacing positions. The railing is extendible to adapt to different opening widths. The gates of the prior art, however, may fail in adequately providing a loading space which is sealed off at least at one end while the other end of the loading space is open, under all circumstances. Much of the prior art fails to provide an off-limits area to personnel, while a safety gate has been lifted at the edge of a mezzanine floor.

The prior art often fails to appreciate that some form of safety arrangement must be made to define the work area and to define a shipping area with a definitive noncrossable border therebetween.

It is therefor an object of the present invention, to overcome the disadvantages of the prior art.

It is yet a further object of the present invention to provide a simple yet very efficient means by which a safety gate is always down, either defining a particular shipping area, or defining a particular safety rail on that shipping area.

BRIEF SUMMARY OF THE INVENTION

Present invention provides a safety gate assembly for mezzanines or other elevated platforms, so as to provide a solid barrier which satisfies safety regulations and which barrier is always in place, locking an opening for an entry way on a mezzanine floor, or defining a shipping area adjacent to that opening, through which no mezzanine or assembly floor personnel may pass.

The safety gate assembly of the present invention comprises a frame assembly which may be installed adjacent a ledge or elevated platform on a mezzanine work floor. The frame assembly comprises a first pair of spaced apart parallel rails arranged in a vertical manner. A second pair of spaced apart parallel rails arranged in a vertical manner defines another side of the frame assembly. The first and second pairs of spaced apart rails each define themselves spaced apart side portions of the frame assembly. The side portions are secured to one another at their spaced apart locations by a horizontal frame arrangement. The horizontal frame arrangement and the spaced apart side rails define a cage-like assembly and a first generally rectangularly shaped transfer area as a "footprint" on the raised mezzanine floor. The frame assembly has a leading side, which is in general vertical alignment with the edge of the mezzanine floor as defined by the safety rail. A rectangularly shaped leading or front gate has a pair of rollers at each end thereof which are in rolling engagement with the side rails at each end thereof.

A rear gate arrangement is vertically slidably disposed on the backside of each set of parallel side rails. The rear gate assembly comprises a pair of parallel side walls in parallel alignment with the side rails of the frame assembly, and a rear wall, joining the parallel side walls along a rearmost edge thereof.

The rear gate assembly defines a second generally rectangularly shaped area on the mezzanine floor adjacent the first generally rectangularly shaped "footprint" area under the frame assembly.

The rear gate assembly has a pair of wheels which rotatably engaged the rear side of the side rails so as to permit the rear gate assembly to slidingly move upwardly and downwardly thereon. A balancing means is arranged across the side rail portions in the frame assembly to facilitate the raising and lowering of the front gate and the rear gate alternatively. The balancing means comprises a pair of pulleys arranged on opposite ends of an elongated axis. The elongated axis is supportively disposed in a horizontal orientation at the upper end of each side rail assembly. Each pulley is rotatably disposed on that elongated axis. A cord or chain is attached to each end of the front or outermost gate, and is disposed over the upper end of each respective pulley on the elongated axis. The other end of the cord or the chain is attached to their respective end walls of the rear gate assembly. The length of the chain or the cord is such that when the rear gate assembly is in its raised orientation, at the upper end of the backside of the side rail assembly, the front gate is in its lowermost position at the front side of the frame assembly. When the rear gate assembly is in its lowermost position at the rear side of the frame assembly, the front gate is caused to be in its uppermost orientation on the front side of the frame assembly.

When the rear gate assembly is in its lowermost orientation, an enlarged enclosed rectangularly shaped "safe" area is defined by the rear gate assembly. That rear gate assembly permits pallet loads and/or small items to be placed therewithin for transfer across the edge of the mezzanine floor. The rear gate assembly has no upper frame thereacross so as to hinder a worker or fork lift truck from working within that area, while it does permit the mezzanine worker on the other side of the walls/gate access to that restricted area from the three sides of the rear gate, the height of the side and rear walls of the rear gate assembly being no more than four feet.

The side rail assemblies have a transverse frame member extending across their lowermost edge so as to provide a rigid footing and support therefor. This frame assembly, thus may be made in a portable manner and brought to a site so as to permit simplified assembly and rapid installation of a safety gate where it may be temporarily necessary. The lower footing also has extended portions, so as to facilitate stability of the frame assembly on the floor, and to resist tilting thereof when the rear gate assembly is in its uppermost orientation.

What has therefore been shown, is a unique, portable, tri-sided safety gate assembly which permits a first gate to be lowered when a rear gate defining a large safety area, is raised.

The invention thus comprises a safety gate assembly for providing a defined work and shipping area at the edge of a raised or mezzanine floor, comprising a frame assembly having a pair of spaced apart side rails secured together by a horizontally exposed transverse frame assembly, the frame assembly defining a generally rectangularly shaped equipment; a front gate vertically moveable with respect to the side rail assemblies and a rear gate assembly which is vertically removable with respect to the side rails, the rear gate assembly defining a box-like space having a generally rectangularly shaped footprint for defining a further work and shipping area within the gate assembly. The safety gate assembly includes a balancing means for reciprocally moving the first gate and the rear gate assembly. The rear gate assembly is defined by a pair of parallel side walls which are joined together at their rearward end by a rear wall. The rear gate assembly has a plurality of wheels which are rotatably engaged with the side rail assembly to permit relative smooth rotative motion therebetween.

The balancing means comprises an elongated axis engaged supportably in the side assemblies, with a pair of pulleys thereon, the pulleys having cords therearound and attached to the front and rear gates respectively. The gates may be weighted similarly so as to permit ease of reciprocal motion therebetween, even though the rear gate is larger than the front gate.

BRIEF DESCRIPTION OF THE DRAWINGS

The objects and advantages of the present invention will become more apparent when viewed in conjunction with the following drawings, in which.

DESCRIPTION OF THE PREFERRED EMBODIMENTS

Present invention provides a safety gate assembly for mezzanines or other elevated platforms, so as to provide a solid barrier which satisfies safety regulations and which barrier is always in place, locking an opening for an entry way on a mezzanine floor, or defining a shipping area adjacent to that opening, through which no assembly floor personnel may pass.

Figure 1:
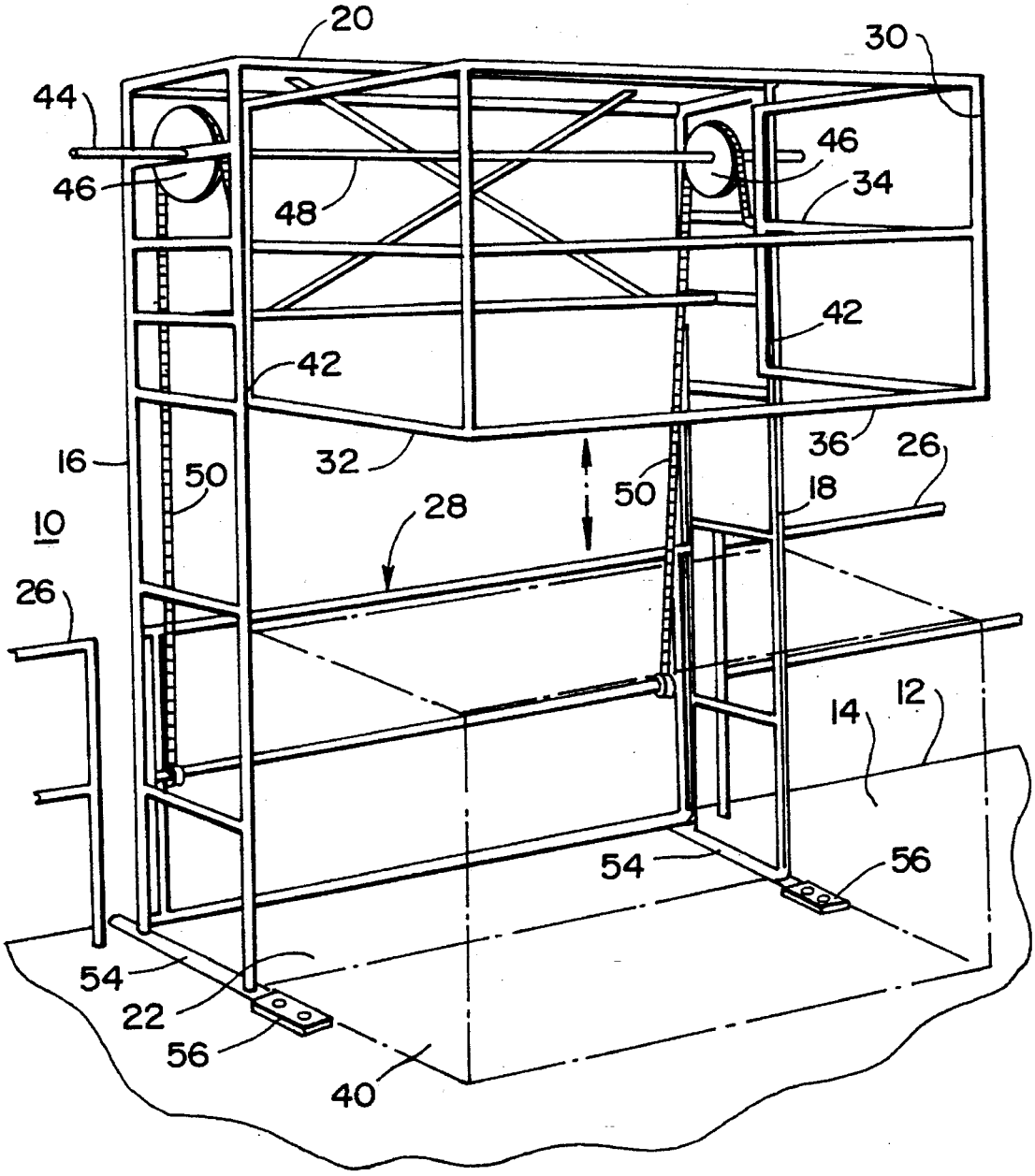
FIG. 1 is a perspective view of a safety gate assembly constructed according to the principles of the present invention.
Figure 2:
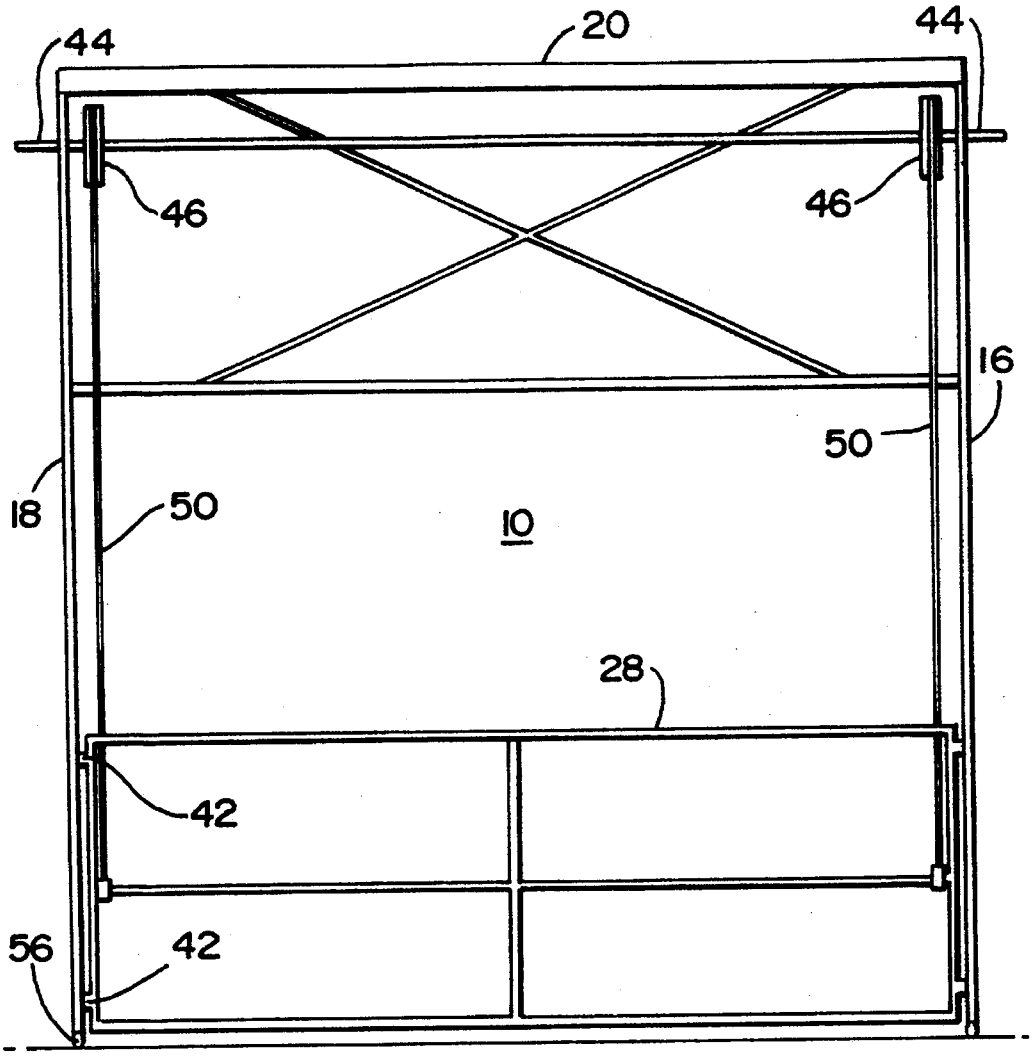
FIG. 2 is a front elevational view of the frame assembly.
Figure 4:
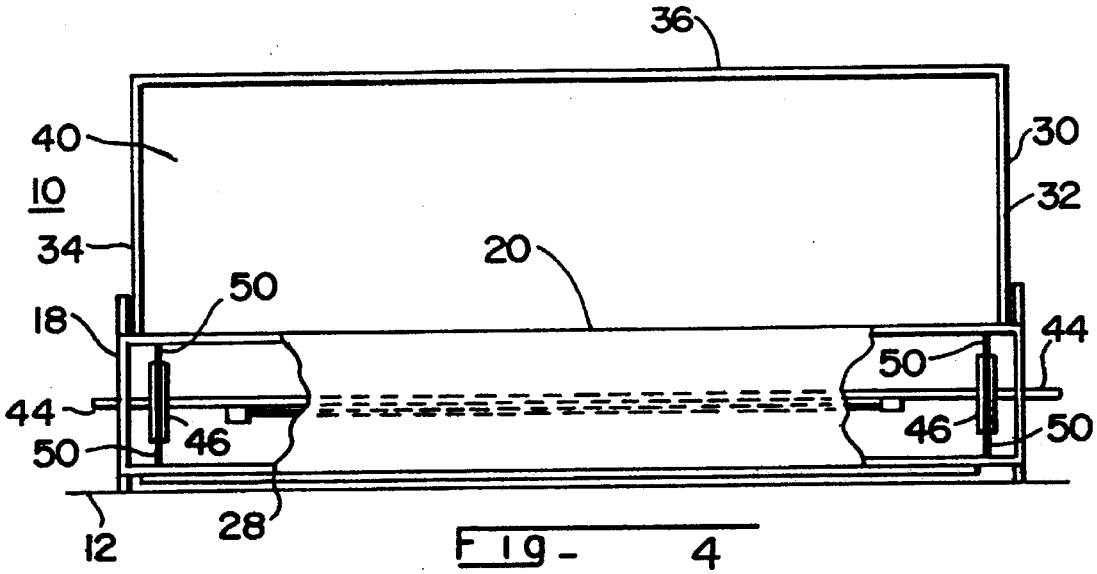
FIG. 4 is a plan view of the frame assembly of the present invention.
Figure 3:
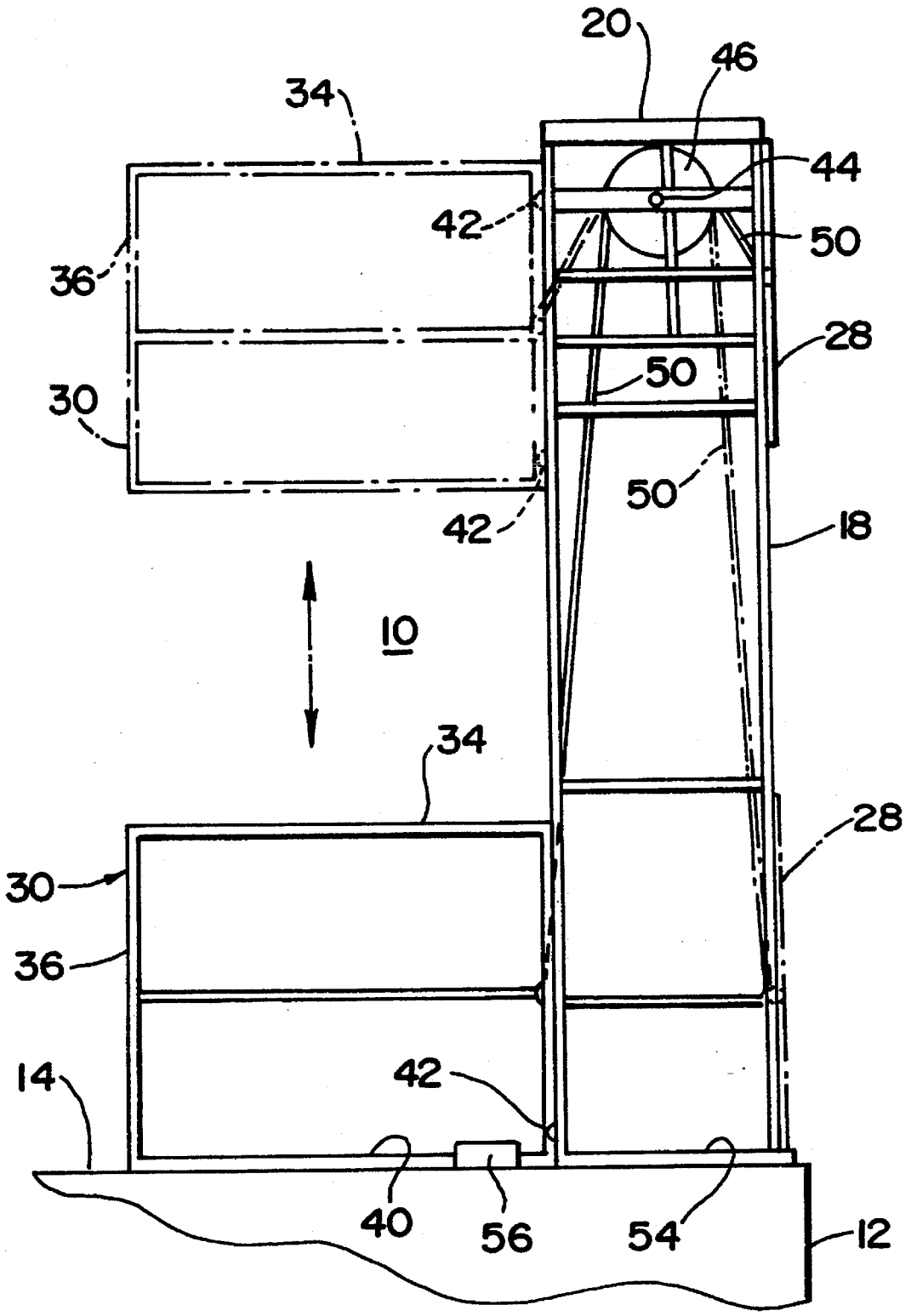
FIG. 3 is a side elevational view of the frame assembly of the present invention.

The safety gate assembly of the present invention, as shown in FIG. 1, comprises a frame assembly 10 which may be installed adjacent a ledge 12 or elevated platform on a mezzanine work floor 14. The frame assembly 10 comprises a first pair of spaced apart parallel rails 16 arranged in a vertical manner. A second pair of spaced apart parallel rails 18, also arranged in a vertical manner defines another side of the frame assembly 10. The first and second pairs of spaced rails 16 and 18, each define by themselves spaced apart side portions of the frame assembly 10. The side portions 16 and 18 are secured to one another at their spaced apart locations by an upper horizontal frame arrangement 20. The horizontal frame arrangement 20 and the spaced apart side rails 16 and 18 define a cage-like assembly and a first generally rectangularly shaped transfer area as a "footprint" 22 on the raised mezzanine floor 14. The frame assembly 10 has a leading or front side 24, which is general vertical alignment with the edge 12 of the mezzanine floor 14 as defined by a safety rail 26. A rectangularly shaped front gate 28 has a pair of rollers, not shown, at each end thereof which are in rolling engagement with the side rails 16 and 18, at each end thereof.

A rear gate assembly 30 is vertically slidably disposed on the backside of each set of parallel side rails 16 and 18. The rear gate assembly 30 comprises a pair of parallel side walls 32 and 34 which are also in parallel alignment with the side rails 16 and 18 of the frame assembly 10. The rear gate arrangement 30 has a rear wall 36 joining the parallel side walls 32 and 34 along a rearmost edge, all of which are generally about 4 feet in height.

The rear gate assembly 30 thus defines a second generally rectangularly shaped important "protected" area 40 on the mezzanine floor 14, as shown in FIG. 1, adjacent of the first generally rectangularly shaped area 22, under the frame assembly 10.

The rear gate assembly 30 may have a pair of wheels 42 which rotatably engaged the rear side of the side rails 16 and 18 so as to permit the rear gate assembly 30 to slidingly move upwardly and downwardly thereon. A balance means 44, shown in FIGS. 1–4, is arranged across the side rail portions 16 and 18 in the frame assembly 10 to facilitate the raising and lowering of the front gate 28 and the rear gate 30 alternately. The balancing means 44 comprises a pair of pulleys 46 arranged on opposite ends of an elongated axis 48. The elongated axis 48 is supportively disposed in a horizontal orientation at the upper end of each side rail assembly 16 and 18. Each pulley 46 is rotatably disposed on that elongated axis 48. A cord or chain 50 is attached to each end of the first or outermost gate 28, at a vertical mid-point thereon, and is disposed over the upper end of each respective pulley 46 on the elongated axis 48. The other end of the cord or the chain 50 is attached to their respective end walls of the rear gate assembly 30, at a mid-point thereof. The length of the chain or the cord 50 is such that when the rear gate assembly 30 is in its raised orientation, at the upper end of the backside of the side rail assemblies 16 and 18, the front gate 28 is in its lowermost position at the front side of the frame assembly 10. This is shown in phantom lines in FIG. 3. When the rear gate assembly 30 is in its lowermost position at the rear side of the frame assembly 10, the front gate 28 is caused to be in its uppermost orientation on the front side of the frame assembly 10, as shown in solid lines in FIG. 3.

When the rear gate assembly 30 is in its lowermost orientation, an "enlarged" enclosed area 22 and 40, may otherwise be defined by the footprint 22 and the rear gate assembly 30. That rear gate assembly 30 also permits tall items to be placed therewithin without hitting an overhead frame or structure, for transfer across the edge 12 of the mezzanine floor 14. The rear gate assembly 30 importantly therefore, has no upper frame directly over it so as to hinder a worker or fork lift truck from working within or servicing, (through its extended fork lift prongs), that area 22 and 40, or hindering a mezzanine worker from reaching over those side and rear walls to assist or pass articles thereover, those walls being no higher than about four feet.

The side rail assemblies 16 and 18 each have a transverse frame member 54 extending across their lowermost edge so as to provide a rigid footing and support therefor. The frame assembly 10 thus may be made in a portable manner and brought to a site so as to permit simplified assembly and rapid installation of a safety gate where it may be temporarily necessary, or it may be bolted to the floor through bolt holes, not shown, in the frame member 54. The lower footing of the side rails members 16 and 18 each has bolted-on extended portions 56, so as to facilitate stability of the frame assembly on the floor, and to resist tilting thereof when the rear gate assembly 30 is in its upper-most orientation.

What has therefore been shown, is a unique portable moveable safety gate assembly which permits a first gate to be lowered when a rear gate defining a large safety area, is raised.

I claim:

1. A safety gate assembly for providing a defined safe work and shipping area at the edge of a raised or mezzanine floor, comprising:

a frame assembly having a pair of spaced apart side rails secured together at their uppermost ends by an overhead horizontally disposed transverse frame arrangement, said frame assembly defining a generally rectangularly shaped box-like enclosure;

a front gate assembly vertically moveable on and with respect to said frame assembly which is comprised of said side rails;

a rear gate assembly, vertically movable on and with respect to said frame assembly, said rear gate assembly defining a three-sided further box-like space having a generally rectangularly shaped footprint for defining a protected further work and shipping area within said gate assembly, and a balancing means arranged between said gates and said frame assembly, to permit each of said gates to be movable in opposite directions, simultaneously with respect to one another.

2. A safety gate assembly as recited in claim 1, wherein said balancing means is arranged for reciprocally moving said front gate in one direction when said rear gate assembly is moved in the other direction.

3. A safety gate assembly as recited in claim 2, wherein said rear gate assembly is defined by a pair of parallel side walls which are joined together at their rearward end by a rear wall.

4. A safety gate assembly as recited in claim 3, wherein said rear gate assembly has a plurality of wheels which are rotatably engaged with respect to said frame assembly to permit relative smooth rotative motion therebetween to allow said rear gate to ride up or down smoothly thereon.

5. A safety gate assembly as recited in claim 4, wherein said balancing means comprises an elongated axis engaged supportively in said frame assembly, which balancing means is in supportive communication with said front and rear gate assemblies.

6. A safety gate assembly as recited in claim 3, wherein said side walls and said rear wall comprising said rear gate are of a height sufficient to deny a mezzanine worker entry access to the area therewithin, but low enough to permit a worker to reach over said walls to place or adjust articles therewithin.

7. A safety gate assembly as recited in claim 6, wherein said side and rear walls are no more than about four feet in height.

8. A safety gate assembly as recited in claim 1, wherein each of said side rails have a lower frame foot portion which extend transversely beyond the longitudinal axis of said side rails, to permit a broader footing and support for said side rails and hence said frame assembly.

9. A safety gate assembly as recited in claim 8, wherein said footing for said side rails has means therewith for securement to a mezzanine floor.

10. A method of providing a safe area at an edge of a mezzanine floor, where goods may be transferred from one floor level to another floor level, and where workers on the mezzanine floor will be prevented from access to dangerous places thereon, comprising the steps of:

arranging a frame assembly at the edge of the mezzanine floor;

placing a front gate on said frame assembly which gate is movable upwardly and downwardly with respect thereto;

arranging a tri-sided walled rear gate assembly, which tri-sided walled assembly defines an extended rectangularly shaped protected area on the other or rear side of said frame assembly with respect to said front gate assembly; and moving one of said gates in one direction so as to effect movement of the other of said gates in the other direction, to keep mezzanine floor workers from passing over the edge of said mezzanine floor.

11. The method as recited in claim 10, including the step of:

limiting the height of said rear gate to no greater than four feet so that a mezzanine worker may have access to the area defined by said rear gate, by reaching over the tri-sided walled gate, but may not enter the area defined by the rear gate when said rear gate is in its lowermost orientation and said front gate is in its uppermost orientation.

* * * * *